US005913502A

United States Patent [19]

Smith

[11] Patent Number: 5,913,502

[45] **Date of Patent: *Jun. 22, 1999**

[54] DOCUMENT HOLDER

[76] Inventor: Jimmie Wesley Smith, 5005 E. Lee St., Greensboro, N.C. 27406

[ * ] Notice: This patent issued on a continued prosecution application filed under 37 CFR 1.53(d), and is subject to the twenty year patent term provisions of 35 U.S.C. 154(a)(2).

[21] Appl. No.: 08/839,987

[22] Filed: Apr. 24, 1997

[51] Int. Cl.[6] ..... A47B 23/06

[52] U.S. Cl. ..... 248/445; 248/444.1; 248/447.1; 248/451; 248/223.41

[58] Field of Search ..... 248/444.1, 445, 248/446, 447.1, 451, 448, 441.1, 447, 220.21, 220.22, 223.41, 223.51, 224.61, 452, 453, 225.11

[56] References Cited

U.S. PATENT DOCUMENTS

| | | | |
|---|---|---|---|
| 864,254 | 8/1907 | Perkins | 248/451 X |
| 1,245,890 | 11/1917 | Dunmar | 248/451 |
| 1,356,745 | 10/1920 | Schwartz et al. | 248/224.51 |
| 2,337,675 | 12/1943 | McNeil | 248/445 |
| 2,732,159 | 1/1956 | Connors et al. | 248/224.51 |
| 2,896,364 | 7/1959 | McCollister | 248/445 |
| 3,350,150 | 10/1967 | Schwarm | 248/445 X |
| 3,790,770 | 2/1974 | Stern | 248/445 X |
| 4,140,296 | 2/1979 | Guzman Guillen | 248/445 |
| 4,431,156 | 2/1984 | Mena | 248/445 |
| 4,465,255 | 8/1984 | Hill | 248/445 X |
| 4,496,127 | 1/1985 | Nelson | 248/441.1 |
| 4,591,124 | 5/1986 | Hellenbrand | 248/447.2 |
| 4,867,407 | 9/1989 | Becker | 248/444.1 |
| 4,925,144 | 5/1990 | White | 248/445 |
| 5,086,958 | 2/1992 | Nagy | 248/224.51 X |
| 5,112,021 | 5/1992 | Greene | 248/445 X |
| 5,351,927 | 10/1994 | Howell | 248/444.1 |
| 5,458,312 | 10/1995 | Goldberg | 248/444.1 |

*Primary Examiner*—Ramon O. Ramirez
*Assistant Examiner*—Stephen S. Wentsler

[57] ABSTRACT

The present invention is a unique solution to the problem of holding a document in a position to read the document while reclining in a bed or on a horizontal surface. In the prior art attempt to achieve positioning a document relative to a reclining user's field of view have been complex, costly and limited in the type of document positioned. The present invention is simple to install, light in weight so it can be easily positioned by a user and accommodates documents in sizes ranging from newspapers to paperback books. Paperback books are particularly difficult to accommodate because they tend to resist lying flat when opened. In the present invention a book clamp is positioned on the spine of the book and pushes the spine against the base flattening the paperback book. The present invention has a flexible attachment means functioning to attach the document holder to a vertical surface and provide a means of adjustment.

6 Claims, 3 Drawing Sheets

DOCUMENT HOLDER

BACKGROUND OF THE INVENTION

1. Field of the Invention

This invention pertains to a device which holds documents such as books over a supine individual for reading thereof.

2. Description of the Prior Art and Objectives of the Invention

Reading printed material is an important method of acquiring information. Most people spend a considerable amount of time in this pursuit, either for pleasure or business. While not generally tiring, reading can cause fatigue when the item being read is positioned above the body when the body is in a supine or reclined position, such as when lying in bed. Book holders have been recognized in the prior art which position the item to be read over or near a reclined user. These inventions are bulky, very large, or overly complex and do not suit the purpose because they make it difficult to turn the pages and are hard to operate from the reclined position. What is needed is a device that adequately supports a document at a position determined by the user's optical characteristics and can be operated by the user from a reclined or supine position.

Several patents address document holders, in particular, U.S. Pat. Nos. 4,925,144; 4,591,124; 4,496,127; and 4,431,156.

It is an objective of the present invention to provide a document holder having a transparent base for easy use by one in a reclining position.

Another objective of the invention is to provide a document holder which can be releasably attached to a vertical wall by an adjustable, flexible support.

Yet another objective of the invention is to provide a document holder which includes a springy, L-shaped document clamp which will hold a document such as a book in a flattened posture against a base.

A further objective of the invention is to provide a document holder which is light in weight and is simple to install.

These and other objectives and advantages will become readily apparent to those skilled in the art upon reference to the following detailed description and accompanying drawing figures.

SUMMARY OF THE INVENTION

The aforedescribed objectives and advantages are realized by providing a document holder comprising a planar transparent base with a pair of upright lips positioned on opposing ends of the base. An L-shaped document clamp is attached to the interior side of one of the lips whereby the document can be preferably placed between the lips, clamp and the upper surface of the planar base. A base support is attached to the exterior surface of the lip that is attached to the L-shaped clamp. Extending from the base support is the proximal end of a flexible elongated member to allow easy adjustment of the document holder. The distal end of the elongated member is attached to a trapezoidal planar body which releasably fits within a wall bracket mounted on a wall. The wall bracket is attached to the wall by conventional fasteners such as screws, bolts or adhesives. The wall bracket is generally planar and includes an envelope-like sleeve which defines a generally triangular slot on the exterior side thereof. A supine or reclining individual can see through the transparent base and view the text on a document contained therein.

DETAILED DESCRIPTION OF THE PREFERRED EMBODIMENT AND OPERATION OF THE INVENTION

Figure 1:
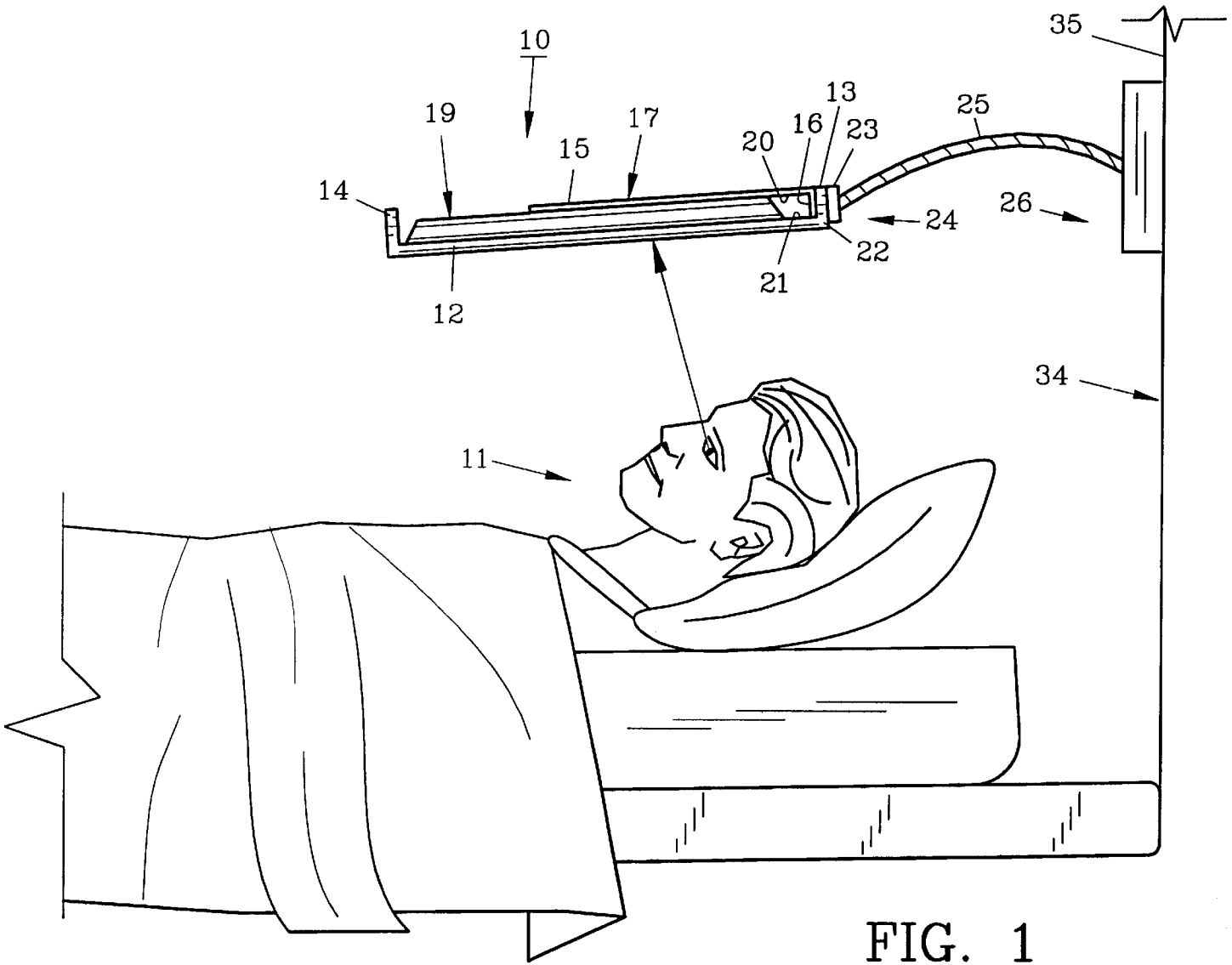
FIG. 1 shows a side view of a supine reader using the document holder of present invention.
Figure 2:
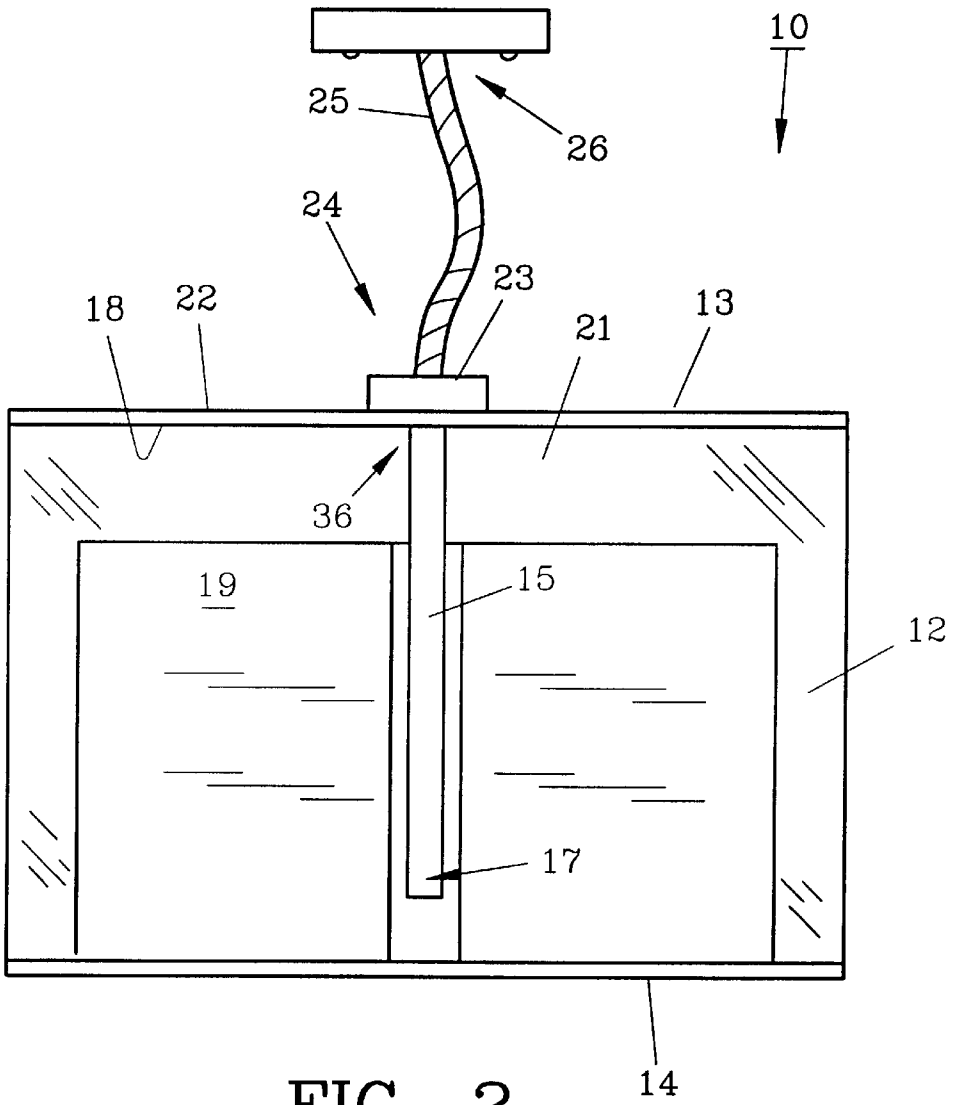
FIG. 2 illustrates a top view of the document holder of FIG. 1.

Turning now to the drawings, specifically FIG. 1 shows reclined reader 11 positioned beneath preferred document holder 10. Document holder 10 comprises planar transparent base 12 with first lip 13 and second lip 14 positioned on opposing sides of base 12 respectively. Lips 13 and 14 extend upward from planar base 12, in a direction generally away from reader 11 therebeneath. L-shaped document clamp 17 is attached to interior surface 18 (FIG. 2) of first lip 13 and sandwiches document or book 19 between lower surface 20 (FIG. 1) of clamp 17 and upper surface 21 of base 12. L-shaped clamp 17 has a horizontal section 15 which is positioned against the spine of book 19 as seen in FIG. 2. The horizontal section 15 is joined to shorter vertical section 16 which is attached to lip 13 as seen in FIG. 1.

Figure 3:
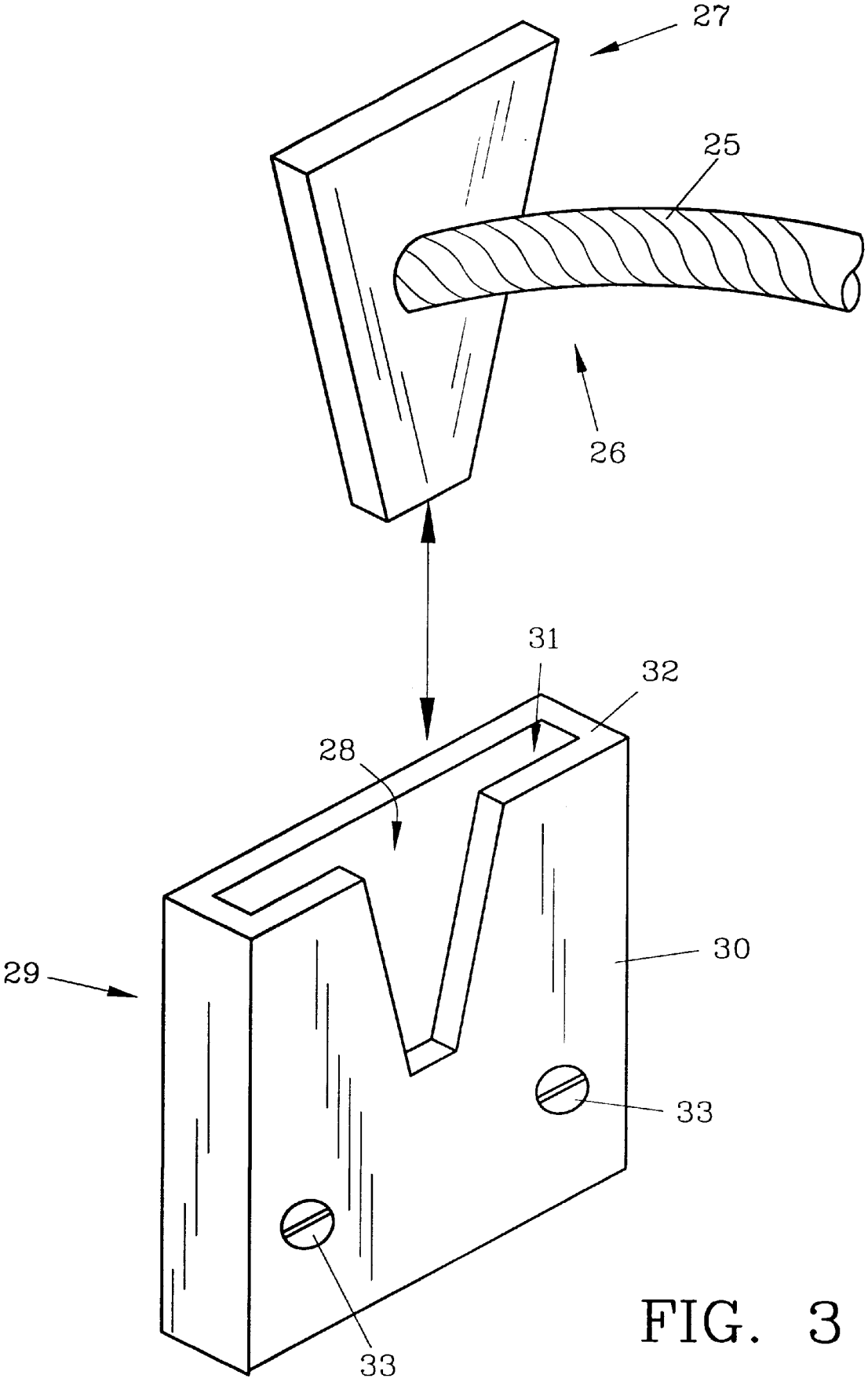
FIG. 3 demonstrates a close up view of the wall bracket and fragmented support member.

While not shown, document clamp 17 is removably and adjustably attached to lip 13. Book 19 is also seen positioned between first lip 13 and second lip 14. Support end 23 is attached to midpoint 36 (FIG. 2) of exterior surface 22 of lip 13. Support end 23 is also attached to proximal end 24 of flexible elongate member 25. Distal end 26 of flexible elongate member 25 may be attached to trapezoidally shaped generally planar wall body 27 (FIG. 3) which is received within envelope 28 of wall bracket 29. Wall bracket 29 defines a generally triangular shaped opening on exterior surface 30 and also defines slot 31 on top surface 32. Conventional fasteners such as screws 33 hold wall bracket 29 to vertical surface 35 of wall 34 (FIG. 1).

While numerous materials can be used in the construction of the present invention, it is preferred that document holder 10 be made of glass, clear plastic or a clear plastic composite. Flexible elongate member 25 is preferably selected from a group consisting of a general flexible member, a telescoping member or rod and clamp means any of which may be made from metal, plastic, plastic composite, metal alloy, rubber, rubber alloy, fiberglass, epoxy, carbon-graphite or wood as desired.

The preceding recitation is provided as an example of the preferred embodiment and is not meant to limit the nature of scope of the present invention or appended claims.

I claim:

1. A document holder comprising:

a transparent base, a first lip and a second lip, said first and said second lips opposingly positioned on said base for containing a document therebetween;

an L-shaped document clamp, said L-shaped document clamp attached to said first lip, said document clamp being spring-like to hold a document against said base, said L-shaped clamp comprising a horizontal section joined to a vertical section, said horizontal section for postioning along the document while said vertical section is attached to said first lip;

a flexible support, a support end, said support end affixed to said flexible support, said support end attached to said first lip; and a wall bracket, said wall bracket joined to said flexible support whereby said document holder can be attached to a wall.

2. The document holder of claim 1 wherein said base is planar.

3. The document holder of claim 1 wherein said flexible support is formed from plastic.

4. A combination of a document holder and a book, said document holder for attachment to a wall, wherein:

said book comprising a spine;

said document holder comprising: a transparent base, a first lip and a second lip, said first and said second lips opposingly positioned on said base thereby containing said book therebetween;

an L-shaped document clamp, said L-shaped document clamp attached to said first lip, said document clamp being spring-like thereby holding said book against said base, said L-shaped clamp comprising a horizontal section joined to a vertical section, said horizontal section positioned along the spine of the book while said vertical section is attached to said first lip;

a flexible support, a support end, said support end affixed to said flexible support, said support end attached to said first lip; and a wall bracket, said wall bracket comprising a front and a rear face, said front and said rear faces spatially aligned to releasably receive said flexible support.

5. The combination of claim 4 wherein said base is planar.

6. The combination of claim 4 wherein said flexible support is formed from plastic.

* * * * *